US012624697B2

(12) United States Patent
Bruin

(10) Patent No.: US 12,624,697 B2
(45) Date of Patent: May 12, 2026

(54) FLOAT BOX WITH VALVE

(71) Applicant: B.B.A. PARTICIPATIES B.V., Klarenbeek (NL)

(72) Inventor: Johannes Bruin, Apeldoorn (NL)

(73) Assignee: B.B.A. PARTICIPATIES B.V., Klarenbeek (NL)

( * ) Notice: Subject to any disclaimer, the term of this patent is extended or adjusted under 35 U.S.C. 154(b) by 0 days.

(21) Appl. No.: 19/140,540

(22) PCT Filed: Dec. 5, 2023

(86) PCT No.: PCT/NL2023/050638
§ 371 (c)(1),
(2) Date: Jun. 18, 2025

(87) PCT Pub. No.: WO2024/136642
PCT Pub. Date: Jun. 27, 2024

(65) Prior Publication Data

US 2026/0043405 A1 Feb. 12, 2026

(30) Foreign Application Priority Data

Dec. 21, 2022 (NL) ..... 2033776

(51) Int. Cl.
*F04D 9/04* (2006.01)

(52) U.S. Cl.
CPC ..... *F04D 9/046* (2013.01); *F04D 9/041* (2013.01)

(58) Field of Classification Search
None
See application file for complete search history.

(56) References Cited

U.S. PATENT DOCUMENTS 1,782,760 A 11/1930 Lovekin
1,803,885 A * 5/1931 Adams ..... F04D 9/001 417/69

(Continued)

FOREIGN PATENT DOCUMENTS

EP 4071360 A1 10/2022
GB 505423 A 5/1939
GB 1342086 A * 12/1973 ..... F04D 15/0218

OTHER PUBLICATIONS

Dutch Search Report from corresponding Dutch Patent Application No. NL2033776, Jun. 27, 2023.

(Continued)

*Primary Examiner* — Nathan C Zollinger
(74) *Attorney, Agent, or Firm* — Workman Nydegger

(57) ABSTRACT

A float box for priming a fluid pump is provided. The float box comprises a floater inside a float chamber, and an air valve assembly that is operated by the floater. The air valve assembly comprises a valve holder that bounds a valve chamber and an insert opening towards the valve chamber, and a valve body that is inserted in the valve chamber. The valve body comprises a valve cover that closes the insert opening, and a seal holder inside the valve chamber. The seal holder has a seal chamber with an access opening where the seal chamber debouches spaced apart from the valve cover. The air valve assembly comprises a seal element with a seal channel inside the seal chamber, and a valve head that is connected with the floater to close off and release the seal channel.

15 Claims, 6 Drawing Sheets

(56) References Cited

U.S. PATENT DOCUMENTS

| | | | | |
|---|---|---|---|---|
| 1,910,775 | A * | 5/1933 | Saxe | F04D 9/041 384/313 |
| 2,033,980 | A | 3/1936 | Durdin, Jr. | |
| 2,033,981 | A * | 3/1936 | Durdin, Jr. | F04D 9/041 137/193 |
| 4,251,240 | A * | 2/1981 | Brennan | F04D 9/003 96/197 |
| 6,409,478 | B1 * | 6/2002 | Carnes | F04D 9/043 417/200 |
| 6,783,330 | B2 * | 8/2004 | Carnes | F04D 9/043 137/434 |
| 12,270,421 | B2 * | 4/2025 | White | F04D 9/048 |
| 2002/0098090 | A1 | 7/2002 | Muhs | |
| 2005/0051211 | A1 * | 3/2005 | Scott | F16K 11/14 137/202 |

OTHER PUBLICATIONS

International Search Report from corresponding PCT Application No. PCT/NL2023/050638, Feb. 21, 2024.

* cited by examiner

FLOAT BOX WITH VALVE

BACKGROUND

The invention relates to a float box for priming a fluid pump, wherein the float box comprises a suction inlet and a suction outlet between which a suction channel extends, a float housing that bounds a float chamber that is in fluid communication with the suction channel, a floater inside the float chamber, and an air valve assembly that is operated by the floater.

A known float box of this type has a valve housing on top of the float housing. The valve housing comprises a mounting flange that is bolted around a hole through the top wall of the float housing, and a vacuum hose connection that is connected to a vacuum pump via a vacuum hose. The housing consists of multiple parts that are bolted to each other to enclose an internal seal element with a seal channel. The air valve assembly comprises a valve head that is connected to the floater to open and close the seal channel to allow a connected vacuum pump to evacuate air from the float chamber. The internal seal element is subject to wear whereby it need to be replaced on a regular basis.

SUMMARY OF THE INVENTION

A disadvantage of the known float box is that the replacement of the internal seal element requires the disassembly of the valve housing from the float housing by unbolting the mounting flange from the top wall, and subsequently the disassembly of the parts of the removed valve housing to reach and remove the internal seal element. Usually the vacuum hose remains connected as it is much work to take it off from the valve housing. After replacement the housing needs to be reassembled and mounted back onto the float housing. This is a complex operation, in particular inside a pump skid housing in which the float box is integrated with a fluid pump and an engine to drive the fluid pump and the vacuum pump as the reachability and the sight on the valve housing are pour.

It is an object of the present invention to provide a float box with an air valve assembly of the abovementioned type, of which a seal element can be replaced easily.

According to a first aspect, the invention provides a float box for priming a fluid pump, wherein the float box comprises a suction inlet and a suction outlet between which a suction channel extends, a float housing that bounds a float chamber that is in fluid communication with the suction channel, a floater inside the float chamber, and an air valve assembly that is operated by the floater, wherein the air valve assembly comprises a valve holder above the float chamber that bounds a valve chamber and an insert opening towards the valve chamber, and a valve body that is inserted in the valve chamber in an insert direction via the insert opening, wherein the valve body comprises a valve cover that closes the insert opening, and a seal holder inside the valve chamber, wherein the seal holder has a seal chamber with an access opening where the seal chamber debouches spaced apart from the valve cover in the insert direction, wherein the air valve assembly comprises a seal element with a seal channel inside the seal chamber, and a valve head that is connected with the floater to close off and release the seal channel.

The float box according to the invention comprises an air valve assembly having a valve body that carries the seal element in the open seal chamber of the seal holder. The valve body can be inserted easily in the valve holder via the access opening of the valve chamber, which can be performed with limited sight or even tactile. When the valve body is taken out of the valve chamber, the element is directly exposed at the access opening to be replaced. This makes the replacement of the seal element easy.

In an embodiment the valve cover is transverse to the insert direction larger than the seal holder whereby it can close off the insert opening by abutment of the valve holder along the insert opening.

In an embodiment the valve cover comprises multiple mounting holes and the valve holder comprises multiple threaded holes that are aligned therewith, wherein the air valve assembly comprises multiple mounting bolts that have a bolt head above the valve cover and a screw thread in the threaded holes of the valve holder. The bolt heads are located above the valve cover while the remainder of the valve body extends below the valve cover. This makes the bolt heads practically accessible from above.

In an embodiment the valve cover comprises multiple threaded holes, wherein the air valve assembly comprises multiple release bolts that have a bolt head above the valve cover and a screw thread in the threaded holes of the valve cover that abut the valve holder aside the insert opening. The heads of the release bolts are located above the valve cover while the remainder of the valve body extends below the valve cover. This makes the bolt heads practically accessible from above. The release bolts can initiate the removal of the valve body from the valve holder.

In an embodiment the valve holder comprises a circumferential wall that bounds the valve chamber and the insert opening, wherein the valve holder has an air evacuation channel through the circumferential wall that debouches in the valve chamber. The valve holder and thereby the air evacuation channel and for example a connected vacuum hose thereby remain in place when the valve body is taken out to replace the seal element.

In an embodiment the valve body comprises a central stem between the valve cover and the seal holder, wherein the stem is transverse to the insert direction smaller than the seal holder and the valve cover. The stem bridges a proper distance between the valve cover and the seal holder to provide a deep position of the seal element inside the valve chamber close to the valve head. The deep position makes the seal element less vulnerable for the accumulation of dirt.

In a combined embodiment the valve cover, the stem and the seal holder bound an air chamber around the stem that is in fluid communication with the seal chamber and the air evacuation channel.

In an embodiment the seal holder extends fully inside the valve chamber, spaced apart from the valve cover in the insert direction.

In an embodiment the valve cover, the stem and the seal holder form one unity or mono piece that can be handled easily.

In an embodiment the valve chamber has an inner wall with a circular cross section, wherein the air valve assembly comprises a seal around the valve body that seals off inside and against the inner wall.

In an embodiment the valve holder comprises a bottom receptacle under the valve chamber, wherein the air valve assembly comprises a guide body that is separate from the valve body and that is received in the bottom receptacle, wherein the seal holder and the guide body together confine the seal element. The guide body can remain in place when the valve body is taken out of the valve holder to expose the seal element.

In an embodiment the guide body comprises a guide channel that is aligned with the seal channel, wherein the valve head extends through the guide channel.

In an embodiment the valve cover and the seal holder are made of a metal.

In an embodiment the seal element is made of a flexible material.

In an embodiment the seal element is a disk shaped seal element and the seal channel extends centrally through the disk shaped seal element.

According to a second aspect, the invention provides a valve body for use in a float box according to the invention.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
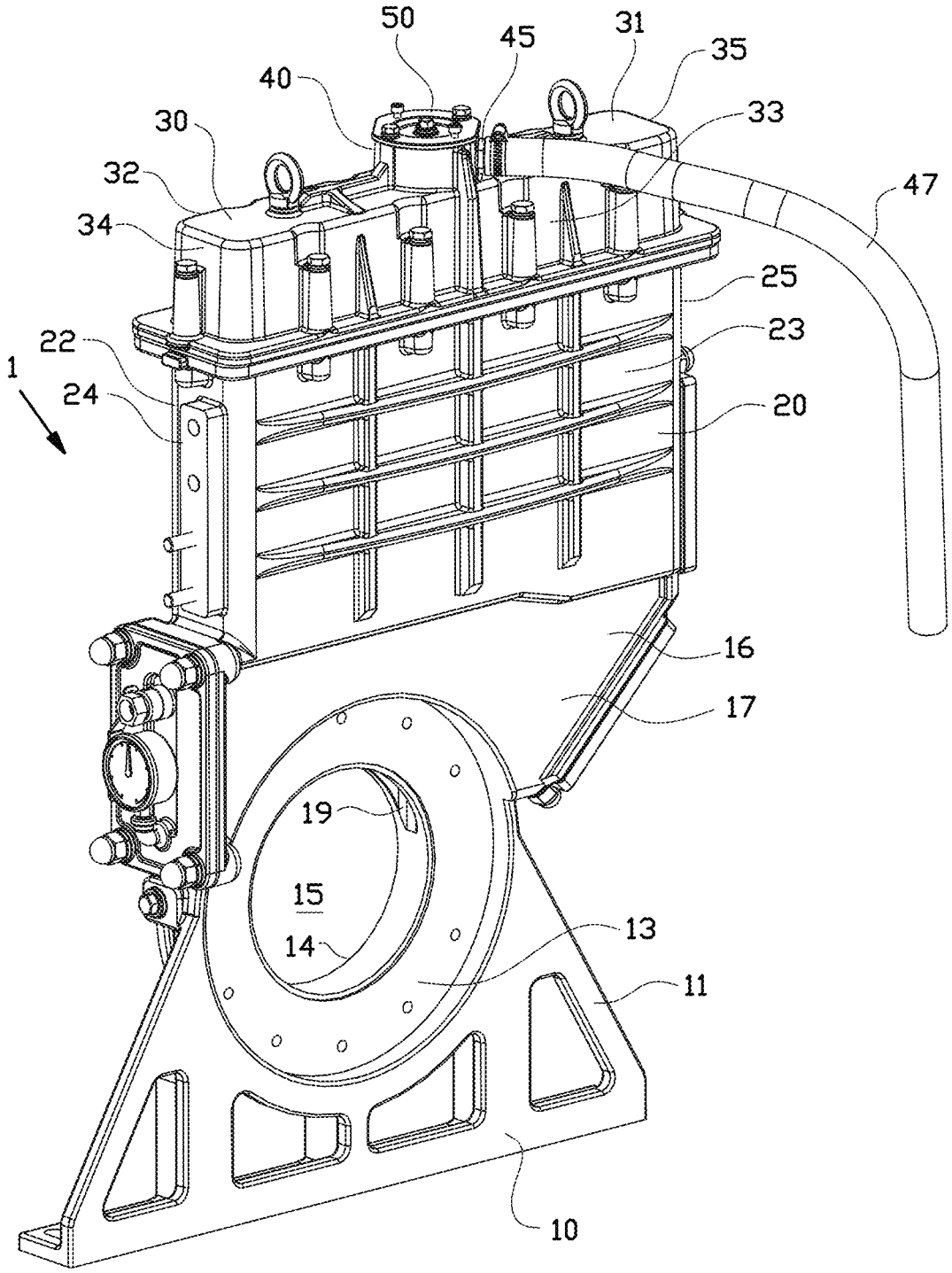
FIG. 1 shows a float box with an air valve according to an embodiment of the invention.
Figure 2A:
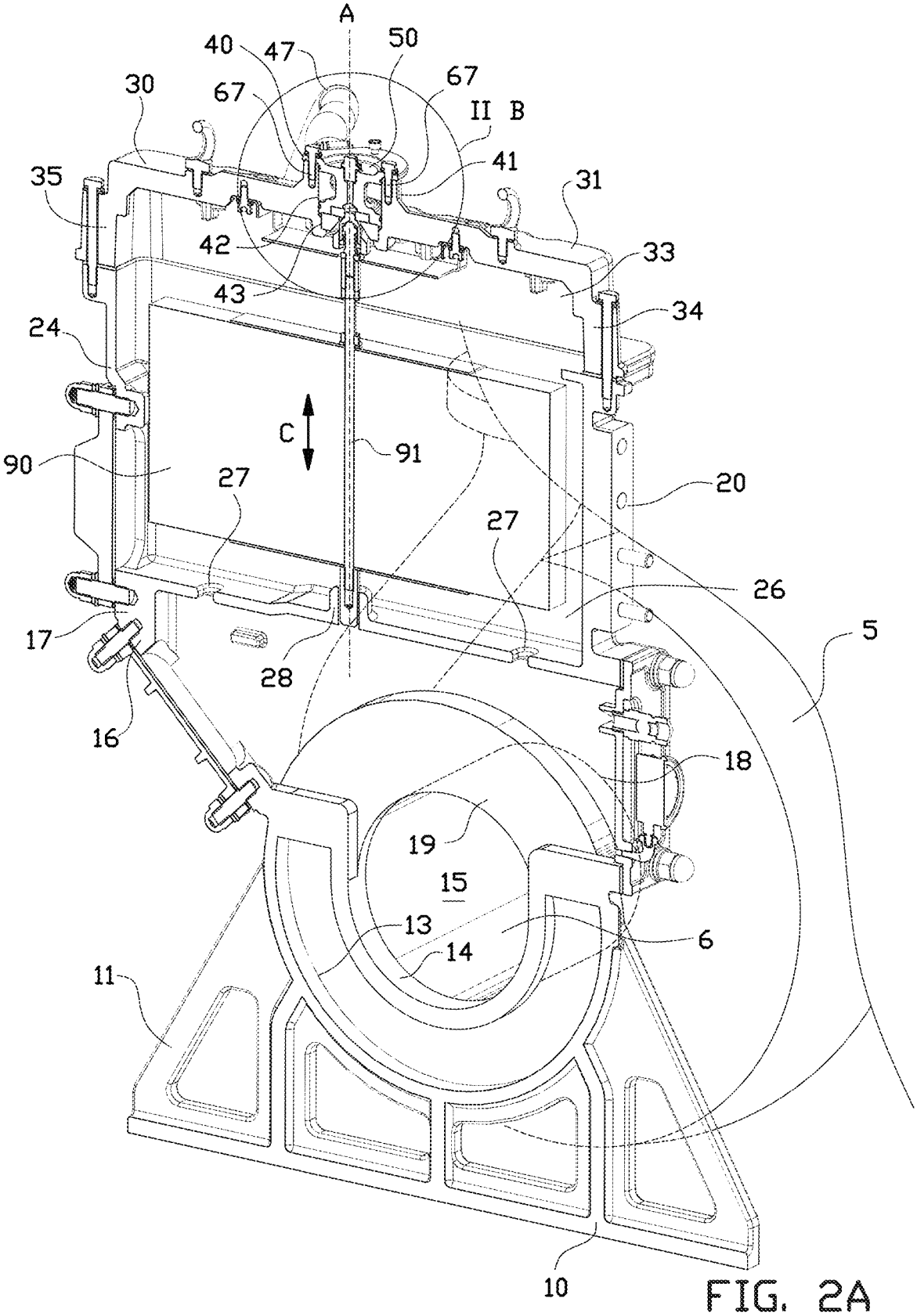
FIG. 2A is an isometric view of a cross section of the float box and a schematically indicated part of a centrifugal pump there behind that is connected thereto.

FIG. 1 shows a float box 1 according to an embodiment of the invention. As shown in FIG. 2A the float box 1 is destined to be installed between the suction inlet 6 of a centrifugal pump 5 and a not shown suction conduit that feeds a fluid to the suction inlet 6 via the float box 1. The float box 1 is used to prime the centrifugal pump 5.

As shown in FIGS. 1 and 2A the float box 1 comprises a metal bottom frame 10 having a foot 11 that merges into a suction inlet connection flange 13 and an opposite suction conduit connection flange 14 between which a suction channel 15 extends. The bottom frame 10 comprises a funnel section 16 above the suction channel 15. The funnel section 16 has a circumferential wall 17 that defines an internal funnel chamber 18 having a bottom opening 19 where the funnel chamber 18 debouches into the suction channel 15.

The float box 1 comprises a rectangular metal float housing 20 above the funnel section 16. The float housing 20 comprises a front wall 22 and a back wall 23 that extend parallel to each other and that merge at the sides into a left side wall 24 and a right side wall 25. The float housing 20 bounds an internal float chamber 26 that is in fluid communication with the funnel chamber 18 via multiple bottom holes 27. The float box 1 comprises a separate metal float box cover 30 that closes off the float housing 20. The float box cover 30 comprises a top wall 31 that merges into a front wall 32, a back wall 33, a left side wall 34 and a right side wall 35.

Figure 2B:
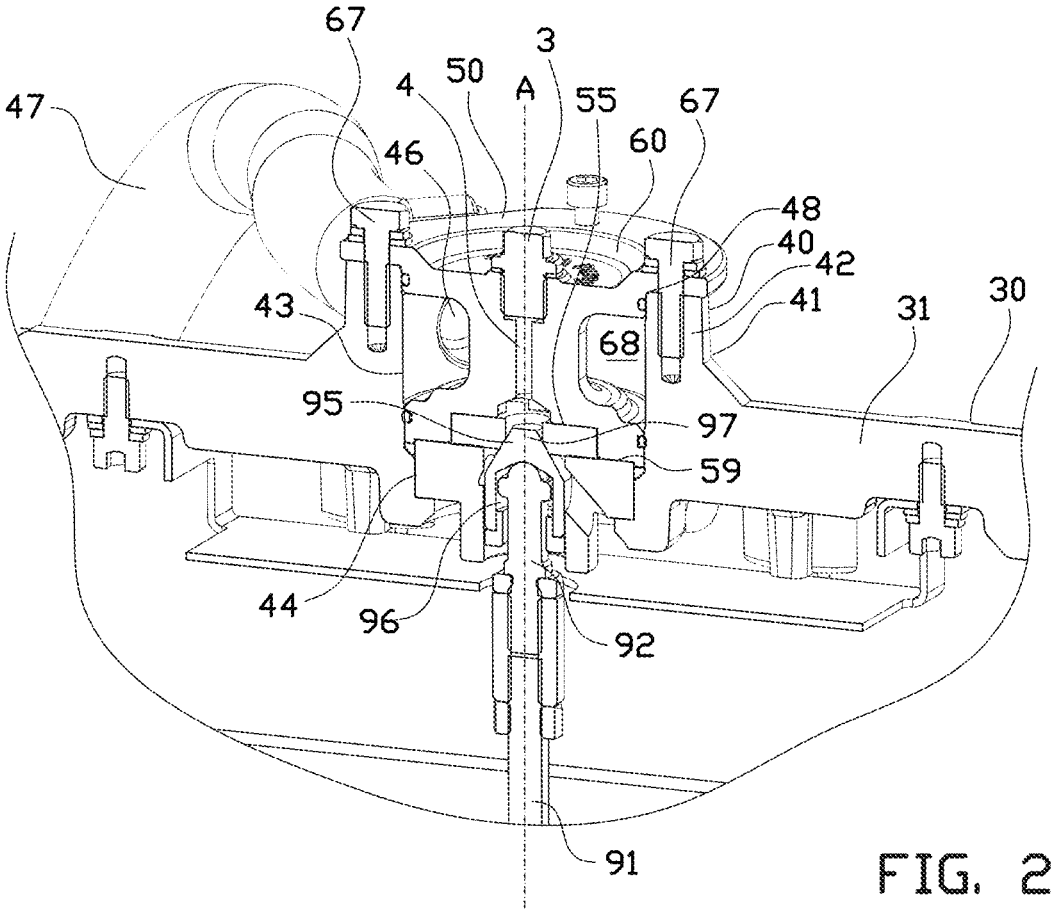
FIG. 2B is a detail of a cross section of the float box of FIG. 1.

The float box 1 comprises an air valve assembly 40 at the top side of the float box cover 30. The air valve assembly 40 comprises a valve holder 41 that is shown in detail in FIG. 2B. The valve holder 41 comprises a cylindrical circumferential wall 42 with a center line A that merges into the top wall 31 of the float box cover 30 and that upwardly projects from the top wall 31. The circumferential wall 42 and the top wall 31 together define a cylindrical valve chamber 43 with an insert opening 48 at the top side of the circumferential wall 42. The valve chamber 43 continues in a cylindrical bottom receptacle 44 with a smaller diameter. The float box 1 comprises a hose pillar 45 that is screwed into the circumferential wall 42 to form an air evacuation channel through the circumferential wall 42. The hose pillar 45 has an opening 46 that debouches into the valve chamber 43. The float box 1 comprises a vacuum hose 47 that is at one end attached to the hose pillar 45 and that is at the other end attached to a not shown vacuum pump to evacuate air from the valve chamber 43.

Figure 3A:
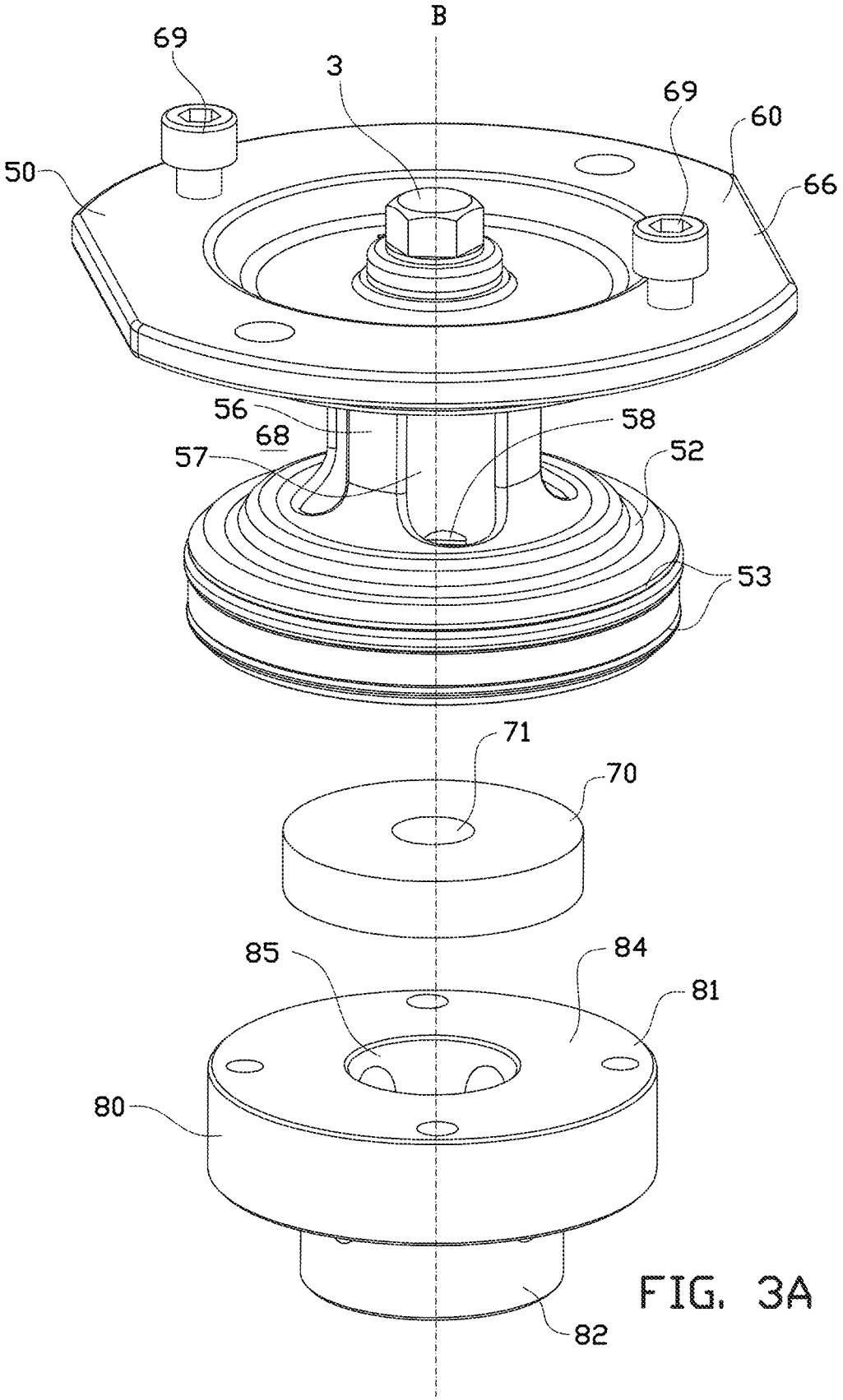
FIGS. 3A, 3B and 3C are an isometric top view, a side view and an isometric bottom view of the air valve of FIGS. 2A and 2B.
Figure 3B:
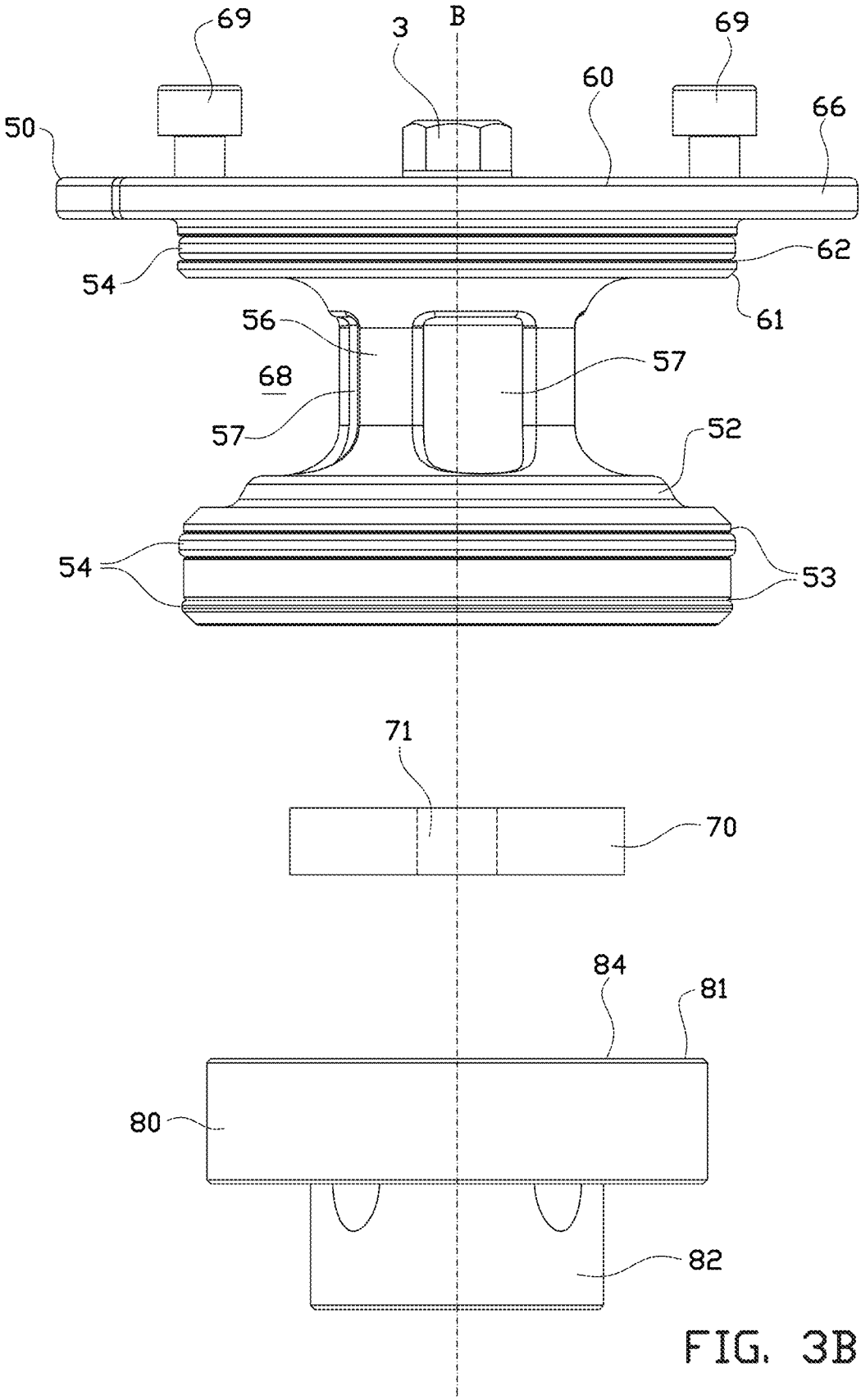
Figure 3C:
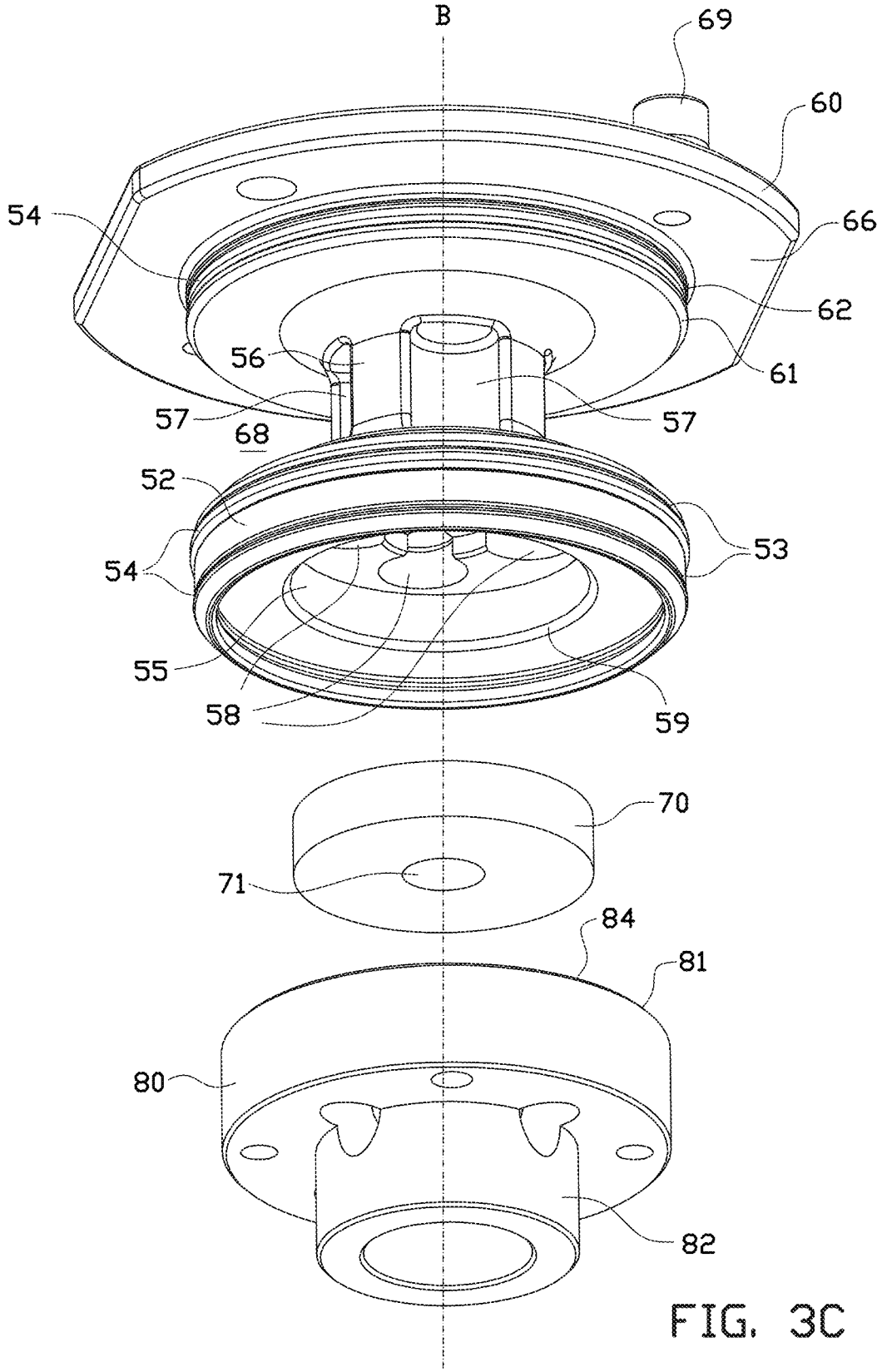

The air valve assembly 40 is also shown in detail in FIGS. 3A-3C. The air valve assembly 40 comprises a metal valve body 50 that is formed as one singe part. The valve body 50 has a center line B and comprises a cylindrical seal holder 52 that fits inside the cylindrical valve chamber 43 and that is in this example provided with two lower circumferential seal grooves 53 that debouche radially and a concentric seal chamber 55 having an access opening 59 where the seal chamber 55 debouches axially downwards with respect to the valve body 50. The valve body 50 comprises a central stem 56 that downwardly merges into the seal holder 52 and that upwardly merges into a valve cover 60. The stem 56 comprises in this example multiple longitudinal grooves 57 that are distributed around the center line B. The longitudinal grooves 57 each have a bottom opening 58 towards the center of the seal chamber 55. The valve cover 60 comprises a cylindrical insert section 61 that fits inside the valve chamber 43, and a wider mounting flange 66 that fits onto the circumferential wall 42. The insert section 61 is in this example provided with one upper circumferential groove 62 that debouches radially. The mounting flange 66 is mounted to the circumferential wall 42 by means of two mounting bolts 67. The air valve assembly 40 comprises two release bolts 69 that are screwed only into the mounting flange 66 to come in abutment with the circumferential wall 42. The air valve assembly 40 comprises a bleed bolt 3 in the center of the valve cover 60 that closes off a bleed channel 4 that extends through the central stem 56 and that debouches centrally in the seal chamber 55.

The air valve assembly 40 comprises a metal guide body 80 having a cylindrical upper section 81 that tightly fits inside the bottom receptacle 44 to remain in place, and a cylindrical lower section 82 with a smaller outer diameter that projects downwardly therefrom. The guide body 80 comprises a straight top surface 84 that abuts the seal holder 52 to confine a disk shaped seal element 70 that is tightly inserted in the seal chamber 55. The guide body 80 comprises a central guide channel 85. The seal element 70 comprises a central seal channel 71 with a smaller diameter that is aligned with the guide channel 85 of the guide body 80 when the seal element 70 is inserted in the seal chamber 55.

The lower seal grooves 53 and the upper circumferential groove 62 hold three seal rings 54 to seal off against the valve chamber 43 in an air tight manner. The seal rings 54 and the seal element 70 are made of an elastic material, for example a synthetic rubber. The insert section 61, the stem 56 and the valve body 50 together define a toroid air chamber 68 around the stem 56 into which the longitudinal grooves 57 radially debouche to communicate with the vacuum hose 47. When inserted, the central axis B of the valve body 50 extends parallel to the central axis A of the circumferential wall 42 of the valve holder 41.

As shown in FIG. 2A, the float box 1 comprises a rectangular floater 90 inside the float chamber 26 that is mounted to a slide rod 91. Below the floater 90 the slide rod 91 extends through a slide bearing 28 of the float housing 20. Above the floater 90 the slide rod 91 is connected to a valve pusher 92. The air valve assembly 40 comprises a metal valve head 95 that is slidable confined in the guide channel 85 of the guide body 80. The valve head 95 comprises a blind channel 96 in which the distal end of the valve pusher 92 is received, and a conical end 97 that is aligned with the seal channel 71 of the seal element 70. The conical end 97 is dimensioned to fit only with its tip into the seal channel 71. The valve head 95 can move in vertical direction C parallel to the center line A, wherein the position is dependent on the amount of fluid inside the float chamber 26.

The float box 1 ensures that air that is enclosed in the suction inlet 6 of the centrifugal pump 5 and the connected suction conduit is evacuated by means of the vacuum pump so that the centrifugal pump 5 is entirely filled with fluid to prime it during the startup. When the suction channel 15 and thereby the float chamber 26 contains only air, the floater 90 is on its lowest position whereby the valve head 95 inside the guide channel 85 is spaced apart from the seal channel 71 to allow the vacuum pump to evacuate air from the suction channel 15 via the vacuum hose 47, the air chamber 68, the longitudinal grooves 57, the float chamber 26 and the funnel chamber 18. When the fluid raises and starts to fill up the suction channel 15, the funnel chamber 18 and finally the float chamber 26, the floater 90 moves upwards in direction C whereby the tip of the conical end 97 of the valve head 95 enters the seal channel 71 of the seal element 70 to close off the air flow towards the toroid air chamber 68 and thereby to the vacuum pump. The centrifugal pump 5 is then primed. When during the fluid pumping some air enters the suction channel 15, it can accumulate into the float chamber 26 whereby the conical end 97 is retracted from the seal channel 71 to allow the vacuum pump to evacuate the air again until the float 90 pushes the conical end 97 back into the seal channel 71.

The stem 56 of the valve body 50 keeps the seal holder 52 with the seal element 70 at the lowest position of the valve body 50, whereby accumulation of dirt originating from the fluid, for example in the seal channel 71, is limited. The seal element 70 is subject to wear whereby it is replaced on a regular basis to prevent that fluid enters the vacuum pump. The seal element 70 can be replaced just by taking out the valve body 50. The valve body 50 is taken out by unscrewing the bleed bolt 3 to cancel the vacuum and by unscrewing the two mounting bolts 67. Subsequently the valve body 50 can be lifted out of the valve chamber 43 while the guide body 80 remains in the bottom receptacle 44. When the valve body 50 is slightly stuck, the release bolts 69 can be tightened to initiate a proper lifting of the valve body 50 with respect to the circumferential wall 42. The unscrewing of the bleed bolt 3 and the two mounting bolts 67 and the tightening of the release bolts 69 can be performed from above with simple hand tools like a wrench.

The valve body 50 can be gripped by hand with the finger tips inside the toroid air chamber 68. After entirely taking out the valve body 50, the old seal element 70 can be flipped out of the seal chamber 55 and a new seal element can be inserted, whereafter the valve body 50 is installed back in the valve chamber 43. The entire operation can be performed from above, even tactile or in the dark without sight on the valve body 50, for example inside a machine housing in which the float box 1 and the centrifugal pump 5 are integrated with a diesel engine, which makes it easy to perform the replacement of the seal element 70 during field operation of the centrifugal pump.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A float box for priming a fluid pump, the float box comprising:

a suction inlet and a suction outlet between which a suction channel extends, a float housing that bounds a float chamber that is in fluid communication with the suction channel, a floater inside the float chamber, and an air valve assembly that is operated by the floater, wherein the air valve assembly comprises a valve holder above the float chamber that bounds a valve chamber and an insert opening towards the valve chamber, and a valve body that is inserted in the valve chamber in an insert direction via the insert opening, wherein the valve body comprises a valve cover that closes the insert opening, and a seal holder inside the valve chamber, wherein the seal holder has a seal chamber with an access opening where the seal chamber debouches spaced apart from the valve cover in the insert direction, wherein the air valve assembly comprises a seal element with a seal channel inside the seal chamber, and a valve head that is connected with the floater to close off and release the seal channel.

2. The float box according to claim 1, wherein the valve cover is transverse to the insert direction larger than the seal holder.

3. The float box according to claim 1, wherein the valve cover comprises multiple mounting holes and the valve holder comprises multiple threaded holes that are aligned therewith, wherein the air valve assembly comprises multiple mounting bolts that have a bolt head above the valve cover and a screw thread in the threaded holes of the valve holder.

4. The float box according to claim 1, wherein the valve cover comprises multiple threaded holes, wherein the air valve assembly comprises multiple release bolts that have a bolt head above the valve cover and a screw thread in the threaded holes of the valve cover that abut the valve holder aside the insert opening.

5. The float box according to claim 1, wherein the valve holder comprises a circumferential wall that bounds the valve chamber and the insert opening, wherein the valve holder has an air evacuation channel through the circumferential wall that debouches in the valve chamber.

6. The float box according to claim 1, wherein the valve body comprises a central stem between the valve cover and the seal holder, wherein the stem is transverse to the insert direction smaller than the seal holder and the valve cover.

7. The float box according to claim 1, wherein the valve holder comprises a circumferential wall that bounds the valve chamber and the insert opening, wherein the valve holder has an air evacuation channel through the circumferential wall that debouches in the valve chamber, and wherein the valve body comprises a central stem between the valve cover and the seal holder, wherein the stem is transverse to the insert direction smaller than the seal holder and the valve cover, wherein the valve cover, the stem and the seal holder bound an air chamber around the stem that is in fluid communication with the seal chamber and the air evacuation channel.

8. The float box according to claim 6, wherein the seal holder extends fully inside the valve chamber, spaced apart from the valve cover in the insert direction.

9. The float box according to claim 1, wherein the valve cover, the stem and the seal holder form one unity or mono piece.

10. The float box according to claim 1, wherein the valve chamber has an inner wall with a circular cross section, wherein the air valve assembly comprises a seal around the valve body that seals off inside and against the inner wall.

11. The float box according to claim 1, wherein the valve holder comprises a bottom receptacle under the valve chamber, and wherein the air valve assembly comprises a guide body that is separate from the valve body and that is received in the bottom receptacle, wherein the seal holder and the guide body together confine the seal element.

12. The float box according to claim 11, wherein the guide body comprises a guide channel that is aligned with the seal channel, wherein the valve head extends through the guide channel.

13. The float box according to claim 1, wherein the valve cover and the seal holder are made of a metal.

14. The float box according to claim 1, wherein the seal element is made of a flexible material.

15. The float box according to claim 1, wherein the seal element is a disk shaped seal element and the seal channel extends centrally through the disk shaped seal element.

* * * * *